US005960888A

United States Patent [19]

Moore, Sr.

[11] Patent Number: 5,960,888

[45] Date of Patent: Oct. 5, 1999

[54] ENGINE FIRE SUPPRESSION SYSTEM

[76] Inventor: Garry L. Moore, Sr., 7114 S. Claiborne Ave., New Orleans, La. 70125-4136

[21] Appl. No.: 09/065,299

[22] Filed: Apr. 23, 1998

[51] Int. Cl.[6] ..... A62C 3/07

[52] U.S. Cl. ..... 169/62; 169/56; 169/60; 169/61

[58] Field of Search ..... 169/62, 56, 57, 169/60, 61

[56] References Cited

U.S. PATENT DOCUMENTS

| | | | |
|---|---|---|---|
| 2,596,761 | 5/1952 | Carpani | 169/62 |
| 2,747,674 | 5/1956 | Hodges | 169/62 |
| 2,841,228 | 7/1958 | Porterfield | 169/62 |
| 3,245,473 | 4/1966 | Hita | 169/62 |
| 3,387,662 | 6/1968 | Molgano, Jr. | 169/62 |
| 3,876,011 | 4/1975 | Poitras | 169/57 |
| 3,961,669 | 6/1976 | Kaneko | 169/62 |
| 3,972,373 | 8/1976 | Nichols et al. | 169/62 |
| 4,201,178 | 5/1980 | Tyrer et al. | 169/60 |
| 4,248,309 | 2/1981 | Hofle et al. | 169/47 |
| 4,982,798 | 1/1991 | Wang | 169/62 |
| 5,486,811 | 1/1996 | Wehrle et al. | 169/60 |
| 5,590,718 | 1/1997 | Bertossi | 169/62 |
| 5,613,564 | 3/1997 | Rhines | 169/62 |
| 5,727,635 | 3/1998 | Doty et al. | 169/62 |

*Primary Examiner*—Andres Kashnikow
*Assistant Examiner*—David Deal
*Attorney, Agent, or Firm*—Henderson & Sturm

[57] ABSTRACT

An engine fire suppression system comprising a canister charged with a fire suppressant material, a piping system connected to the canister and terminating in a U-shaped manifold having a plurality of discharge orifices, a redundant parallel valve system in connection between the canister and the manifold, and a fire detection system controlling the redundant parallel valves having a heat sensing circuit and a smoke sensing circuit. A back up power supply is provided that is constantly maintained at full charge by the vehicle alternator but that has sufficient electrical power to power the system in the event the vehicle battery is removed. In addition, an audible alarm is initiated for several seconds prior to discharging the canister contents and during the discharge of the canister contents to alert vehicle passengers that the canister contents will be discharged or are being discharged.

10 Claims, 1 Drawing Sheet

ENGINE FIRE SUPPRESSION SYSTEM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of fire suppression devices, and more particularly to a fire suppression system adapted for extinguishing fires under the hood of a motor vehicle.

2. Description of Related Art

As can be seen by reference to the following U.S. Pat. Nos. 3,876,011; 3,972,373; 4,248,309; 4,982,798; 5,590,718; and 5,613,564; the prior art is replete with myriad and diverse engine fire suppression devices.

While all of the aforementioned prior art constructions are more than adequate for the basic purpose and function for which they have been specifically designed, they are uniformly deficient with respect to their failure to provide a simple, efficient, and practical engine fire suppression system providing an adequate area of coverage surrounding the engine.

As a consequence of the foregoing situation, there has existed a longstanding need for a new and improved engine fire suppression system and the provision of such a construction is a stated objective of the present invention.

BRIEF SUMMARY OF THE INVENTION

Briefly stated, the present invention provides an engine fire suppression system comprising a canister charged with a fire suppressant material, a piping system connected to the canister and terminating in a U-shaped manifold having a plurality of discharge orifices, a redundant parallel valve system in connection between the canister and the manifold, and a fire detection system controlling the redundant parallel valves having a heat sensing circuit and a smoke sensing circuit. A back up power supply is provided that is constantly maintained at full charge by the vehicle alternator but that has sufficient electrical power to power the system in the event the vehicle battery is removed. In addition, an audible alarm is initiated for several seconds prior to discharging the canister contents and during the discharge of the canister contents to alert vehicle passengers that the canister contents will be discharged or are being discharged.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
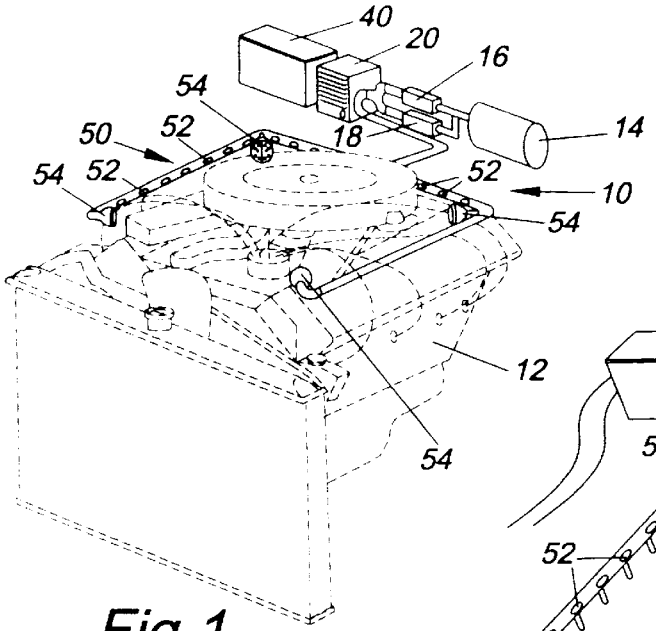
FIG. 1 is a perspective view showing the engine fire suppression system of the present invention installed in the engine compartment of a vehicle.

As can be seen by reference to the drawings, and in particularly to FIG. 1, the engine fire suppression system that forms the basis of the present invention is designated generally by the reference number 10.

Figure 2:
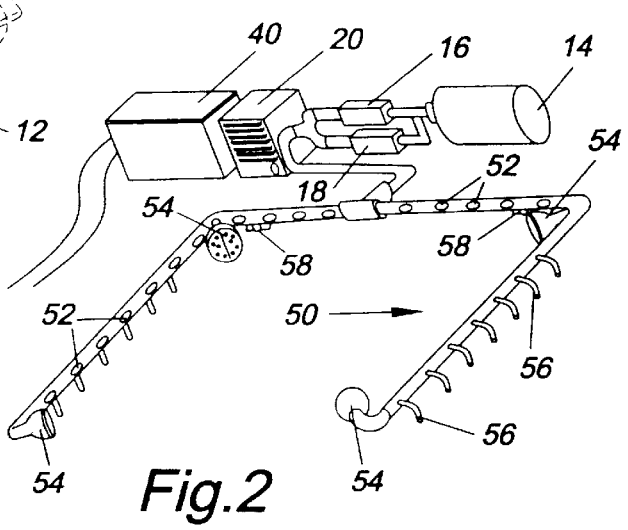
FIG. 2 is a perspective view showing an alternate embodiment of the spray manifold.

The system 10 is installed in the engine compartment of a vehicle adjacent to the engine 12. As best shown in FIG. 2, the system includes an extinguisher canister 14, a primary solenoid 16, a secondary solenoid 18, an electronic detection assembly 20, a 12 volt battery 40, and a stainless steel manifold 50 with inwardly directed orifice spray openings 52, corner spray nozzles 54, and downwardly directed spray nozzles 56.

The system 10 is designed as a self-contained system totally independent from the automotive electrical system or engine components. This technical independence is required to properly protect the automotive engine from fire. The primary focus of the design is a pressurized canister 14 of foam fire extinguisher chemical that is attached to a U-shaped spray head manifold 50 installed over the top portion of the engine 12. The pressurized foam fire extinguisher canister 14 screws into place and is connected to the stainless steel manifold 50 by means of a primary and secondary solenoid valves 16, 18. The secondary solenoid 18 is used as a backup in case the primary solenoid 16 fails to operate. Both operate at the same time and are connected to the canister 14 and the manifold 50 in parallel. When 12 volts DC is applied to the solenoid valves 16, 18, from the unit's battery 40 they open allowing the pressurized foam in the fire extinguisher canister 14 to be released into the stainless steel manifold 50 where it is sprayed over the entire engine 12 through associated orifices 52, corner positioned spray heads 54, and downwardly directed nozzles 56.

The system 10 could also be manufactured with just the four nozzles which would be connected to the foam system via flexible rubber or easily bent metal tubing. The nozzles would be attached to the four corners of the engine bay with the use of universal brackets, allowing the assembly to be easily installed on any vehicle regardless of engine type or size. This configuration would provide a very cost effective kit.

Fire extinguishing foam is automatically sprayed all over the engine 12 by the system 10 as soon as smoke or flame are electronically detected by means of the electronics system 20 located under the hood of the vehicle on or near the fire wall. The electronics 20 and the battery 40 are contained inside of a weatherproof metal box. The electronics 20, like the two solenoids 16, 18, are powered by the self contained 12 volt DC rechargeable battery 40. The battery 40 utilized may be "lead/acid" of the type used on tractors and large motorcycles, or may be of the NiCad type. Both types are kept in constant charge by the vehicle alternator system used to charge the conventional battery of the vehicle. The vehicles electrical system would normally power the unit, with the back up battery taking over in the event that the vehicle power were unavailable, as in the case of a failure of the vehicle's electrical system. Either smoke or heat from a flame will set the automatic alarm electronics system 20 into play, activating the system 10. Both smoke and heat of a flame are detected in order to provide the best overall safety coverage of the engine compartment. The heat detector 22 that is activated by actual heat of flame is selected so as not to be activated by normal engine heat. This prevents false triggering of the system 10. The smoke detector 24 is excellent for detecting the initial beginnings of combustion that is extremely useful in the rapid response time that may be afforded by the system 10.

Figure 3:
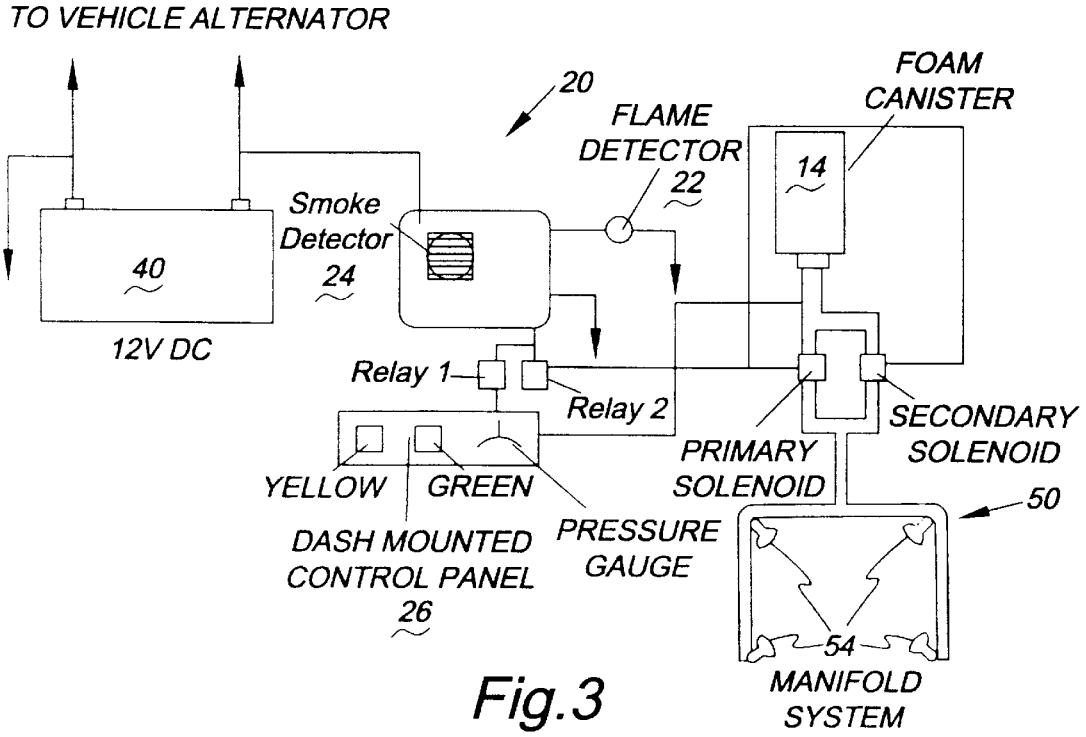
FIG. 3 is a schematic diagram illustrating the operation of the system.

Referring to the block circuit diagram of FIG. 3, 12 volts DC from the battery source 40 is connected to the electronic fire detection circuit assembly 20. It is the signal from this circuit that triggers or activates the solenoids 16, 18 that release the foam from the canister 14 into the stainless steel manifold 50. The fire detection circuitry 20 has three primary component assemblies that allow it to properly function. The smoke detecting electronics are the same as the smoke detectors used in family residences and small businesses. These detectors operate on DC voltages in the range of 9 to 12 volts DC, and usually sound an audible alarm when smoke is detected. The same circuit is utilized with only slight modification. The voltage that normally powers the audible alarm is now connected to two switching relays that close whenever smoke is detected (in place of the alarm). When the relay closes it switches the 12 volt DC power from the battery 40 directly to the primary and secondary solenoids 16, 18, activating the foam into the spray manifold 50 in order to extinguish the beginnings of an engine fire. The heat and flame detector 22 is a snap action button type detector also available as an off the shelf component. This type of detector is a switch that is normally open, but closes whenever the heat it is preset for reaches temperature. These types of switches are also available with an easily accessible reset button. The manufacturer may best determine the temperature rating of this switch after testing of the overall system has occurred. This switch will also trigger the closing of the relays if a fire is detected. This arrangement provides total fire detection and activation of the system 10. The relay system also activates light emitting diode indicators on the dash mounted driver control panel 26. The control panel 26 provide indication of a properly operating system or one that has been activated. As an option, a small pressure gauge may also be located on the control panel 26 indicating proper pressurization of the fire extinguisher canister 14. This would alert the driver to an old canister that needs to be changed or a potential leak in the system. Whenever fire is detected by the electronic package 20, a voltage is switched to the two solenoid valves 16, 18 which opens the valves spraying fire extinguishing foam all over the engine of a vehicle equipped with the system 10.

The sensors 22, 24, may be placed in a variety of locations surrounding the engine. Options include locations dead center of the engine 12 over the air intake, one on or near each corner spray head 54, inside the housing of the electronics package 20, or near the fuel line. One or more sensors may be placed wherever the engine system dictates. Some engines for example, use a carburetor while others use fuel injection. Placement of the sensors for these two engines would more than likely be different. Sensor placement should be considered on a per engine design basis.

The U-shaped stainless steel manifold 50 has three different types of openings that spray foam on the engine. There are four corner located spray heads 54 that are similar to garden sprinkler heads. All four point inward to cover the top portion of the engine 12. Several equally spaced smaller orifices 52 located on the face of the tubular manifold also point toward the engine 12, spraying foam equally around the side perimeter and top sections of the engine. The last set of orifices 56 point toward the engine manifolds. Petcock type valves 58 are located toward the rear of the manifold system 50 and allow condensation to be bled from the internal system of the manifold 50.

A manifold system 50 using only small holes may be employed or a system only using the four corner spray heads 54 may be used. A combination of these is represented as a single version in order to represent total coverage of the fire extinguishing foam. The actual method or combination of methods used should be left to the individual design of an engine and the manufacture.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An engine fire suppression system, comprising:

a canister having a supply of fire suppressant material, the canister being attached within an engine compartment of a vehicle;

a spray manifold including a plurality of discharge orifices directed toward the engine, the manifold being in fluid communication with the canister;

an electrically operated valve system interconnecting the canister and manifold;

a heat sensor disposed within the engine compartment and being electrically coupled to the valve system; and a smoke sensor disposed within the engine compartment and being electrically coupled to the valve system.

2. The system of claim 1 wherein the valve system includes a pair of redundant parallel valves.

3. The system of claim 1 wherein the manifold includes a U-shaped conduit disposed above the perimeter of the engine.

4. The system of claim 3 wherein the manifold includes four inwardly directed spray nozzles attached to the conduit, each of the four nozzles being disposed at a corner of the engine and being directed inwardly toward a central part of the engine.

5. The system of claim 4 further including orifice openings formed in the conduit and directed inwardly toward the engine.

6. The system of claim 5 further including downwardly directed nozzles attached to the conduit and disposed at opposite lateral sides of the engine.

7. The system of claim 1 wherein the heat sensor and the smoke sensor are electrically coupled to a control panel mounted in a passenger compartment of the vehicle.

8. The system of claim 1 wherein the valve system is electrically coupled to a dedicated power source.

9. The system of claim 8 wherein the power source is a 12 volt DC battery disposed within the engine compartment of the vehicle.

10. The system of claim 9 wherein the battery is electrically coupled to an alternator forming a part of an electrical system of the vehicle.

* * * * *